US005606837A

United States Patent [19]

Holizlander

[11] Patent Number: 5,606,837

[45] Date of Patent: Mar. 4, 1997

[54] BRACE SYSTEM FOR USE WITH A TRUSS SYSTEM

[76] Inventor: Mark A. Holizlander, 9741 Pitch Rd., Carmel, Ind. 46032

[21] Appl. No.: 383,986

[22] Filed: Feb. 6, 1995

[51] Int. Cl.[6] ..... E04C 3/30

[52] U.S. Cl. ..... 52/693; 52/713; 52/696; 52/639; 52/92.2

[58] Field of Search ..... 52/693, 695, 696, 52/669, 92.2, 127.2, 373, 713; 403/232.1, 401; 33/613

[56] References Cited

U.S. PATENT DOCUMENTS

| | | | |
|---|---|---|---|
| 1,685,729 | 9/1978 | Stone | 52/695 |
| 2,686,959 | 8/1954 | Robinson . | |
| 2,963,127 | 12/1960 | Manville | 52/693 |
| 3,010,162 | 11/1961 | Klein | 52/696 |
| 3,332,196 | 7/1967 | Tuttle | 52/693 |
| 3,875,719 | 4/1975 | Menge | 52/696 X |
| 4,322,064 | 3/1982 | Jarvis . | |
| 4,490,956 | 1/1985 | Palacio et al. | 52/696 |
| 4,637,195 | 1/1987 | Davis | 52/693 |
| 4,669,235 | 6/1987 | Reinen | 52/370 X |
| 4,712,340 | 12/1987 | Sogge | 52/669 X |
| 4,843,726 | 7/1989 | Ward | 52/127.2 X |

OTHER PUBLICATIONS

Commentary and Recommendations for Handling and Installing Bracing: Metal plate connected wood trusses, HIB–91, The Truss Plate Institute.

Truslock Spacing Tools sales brochure.

Kant–Sag TSX Truss Spacer sales brochure.

Kant–Sag WBT Wind Bracing sales brochure.

*Primary Examiner*—Carl D. Friedman
*Assistant Examiner*—Winnie Yip
*Attorney, Agent, or Firm*—Bose McKinney & Evans

[57] ABSTRACT

A brace provides lateral support to a series of upright truss units of a truss system having at least first, second and third truss units, with each truss unit having at least one beam member having a first surface, that is generally co-planar with corresponding beam members of other truss units. The brace includes a generally continuous, elongated central leg having a first surface, a second surface positioned for engaging a first surface of the beam members of the first, second and third truss units, and a longitudinally extending rib member. The rib member is unitarilly formed with the central leg and extends generally outwardly from the second side surface of the central leg and includes a first opening for receiving the first truss unit, a second unit for receiving the second truss unit, and a third opening for receiving the third truss unit. An elongated first side leg is disposed adjacent and generally perpendicular to the central leg, and includes a first opening for receiving the first truss unit, a second opening for receiving the second truss unit, and a third opening for receiving the third truss unit. First and second ears are disposed adjacent to each of the first, second and third openings of the first side leg. Each of the first ear members is positionable adjacent to the second side surfaces, and each of the second ear members are positionable adjacent to the third side surfaces of the respective beam members of the respective first, second and third truss units. The central leg is comprised of a sufficiently thin, sheetlike material to permit decking material to be placed over the first surface of the central leg and attached to the first surface of the beams of the truss units.

17 Claims, 6 Drawing Sheets

BRACE SYSTEM FOR USE WITH A TRUSS SYSTEM

I. TECHNICAL FIELD OF THE INVENTION

The present invention relates to devices for use in the construction of a building, and more particularly, to a brace for use in connection with a truss system of the type typically used in the roof or floor of a building.

II. BACKGROUND OF THE INVENTION

For quite some time, builders of homes and commercial buildings have used preformed truss systems as a part of the construction of a building. These truss systems are used to span the space between opposed supporting structures, such as to span the space between opposing walls of a building to support its floor. Another, more frequent use of truss systems is to span the distance between opposed supporting walls as part of a roof system of a house or commercial building.

Typically, a truss system is anchored at each end to a supporting wall, and spans the distance between the opposing walls. The truss systems used for supporting a floor comprise an array of truss units, each of which has a flat, upper surface disposed in a horizontal plane. When the truss units are assembled into a truss system, the upper surfaces of the truss units form a plurality of generally co-planar support surfaces over which the floor decking can be placed and to which the floor decking can be attached.

Unlike floor truss systems, roof truss systems take a variety of shapes. Although some roof truss systems provide a plurality of planar, horizontally disposed support surfaces for buildings having flat roof systems, many buildings have roofs, which although planar, are not horizontally disposed. For example, many residential buildings have peaked roofs wherein the roof surface comprises a pair of angled planes having an apex at the crown of the roof. The pitch of a roof can be either more or less steep (i.e., having relatively greater or lesser angle from horizontal) depending upon the desires of the architect or building designer.

Examples of various truss systems and truss units are shown and discussed in TRUSS PLATE INSTITUTE *Commentary and Recommendations for Handling, Installing and Bracing, Metal Plate Connected Wood Trusses*, HIV-91, the TRUSS PLATE INSTITUTE, 583 D'Onofrio Dr., Suite 200, Madison, Wis. 53719 (1991) (the "*TPI HANDBOOK*").

One difficulty that occurs with truss units is stabilizing and bracing them units after they are attached to the supporting walls, and before the decking is applied. A typical construction process by which a truss system is assembled is described below. First, individual truss units are shipped to the construction site. At the construction site, the supporting walls are formed, and generally include an upper supporting beam on each of the upright supporting walls. The truss units are then placed on their ends and attached to the upper supporting beams, to span the space between opposing walls. A plurality of truss units are arrayed in a row from one end of the supporting walls to the other end of the supporting walls.

Most truss units have a much greater height dimension than a width dimension. As such, a truss unit that is supported only at its base by its attachment to a supporting wall is prone to topple over on its side, much like a coin placed on its edge is prone to fall over onto its side.

To prevent the truss units from toppling over on their sides, and to provide support for the truss units so that the construction crew can attach either the floor decking or the roof decking (as appropriate) to the upper surface(s) of the truss units, it is often desirable to brace the truss units to prevent them from falling over like a row of dominos. Several brace systems and brace schemes are known for performing this function, many of which are shown in the *TPI HANDBOOK*.

At page 36 of the *TPI HANDBOOK*, a ground bracing system is shown that comprises a plurality of stakes that are driven into the ground adjacent to the side of a building. A series of diagonal bracing members extend from the ground stakes to the first truss unit to support the first truss unit in an upright position. Additionally, a vertical brace may be attached to the ground brace to provide additional bracing. A series of laterally extending brace members extend generally perpendicular to the truss units to extend between adjacent truss units. These laterally extending brace members are attached to the upper surface of the truss units, and typically comprise 2"×4" wood boards which are nailed to the upper surfaces of the truss units. Once the truss units are so braced, the construction crew can then install the decking, which itself attaches to the upper surfaces of the truss units. As will be appreciated, the decking also provides bracing for the truss units. As a decking is applied, the lateral brace members can be removed successively, until the decking is placed over the entire array of truss units to create the deck of the roof. When all of the decking material is in place over the array of truss units, the lateral stability provided by the decking obviates the need for the ground bracing, which can then be removed.

As best shown at pages 46–49 of the *TPI HANDBOOK*, the laterally extending brace members can also be joined by diagonally disposed brace members to provide additional support for the truss units.

An additional known bracing system is the TRUSLOCK spacing tool manufactured by Truslock, Inc. of Route 1, Box 135, Calvert City, Ky. 42029, which is shown in their sales brochures. The TRUSLOCK tool comprises a plurality of tool segments each of which is designed to extend between a pair of adjacent truss units. Each tool segment includes a flange at each end for engaging a side surface of a truss unit. The TRUSLOCK tool also includes a rivet that connects adjacent tool members to permit adjacent tool members to pivot about each other, and to permit the segments to fold up about each much like a foldable measuring stick. The TRUSLOCK spacing tool is also believed to be shown in Jarvis U.S. Pat. No. 4,322,064.

Another known truss system accessory is the KANT-SAG®, TSX Truss Spacer manufactured by United Steel Products Company of 703 Rogers Drive, Montgomery, Minn. 56069. The KANT-SAG® device is not a truss brace system, but merely a truss spacer system. The KANT-SAG® Truss Spacer comprises an elongated spacing device that is capable of spanning the distance among or between a plurality of truss units. At predetermined intervals, the spacing device includes an opening to permit the spacer to be fit over and to receive beam members of the truss unit. Adjacent to the opening is a aperture through which the spacing device can be nailed to the upper surface of a bem of the truss unit.

Although the devices discussed above most likely perform their intended function in a workmanlike manner, room for improvement exists. In particular, although the TRUSLOCK system functions as a truss spacing and bracing tool, the configuration of the device permits it to be installed on a roof only on a temporary basis. Because the device includes a portion which extends above the plane formed by the upper surfaces of the beams of the truss unit, the TRUSLOCK device is designed to be installed prior to the installation of the decking, and must be removed before the decking can be installed on that portion of the truss unit wherein the TRUSLOCK system resides. This need for removal of the tool can increase the labor costs associated with the use of the tool, when compared to devices which need not be removed.

The KANT-SAG® system appears to be configured so that it may be connected between the truss units on a permanent basis, with the decking being capable of overlaying the KANT-SAG® truss spacer when it is in place on the roof unit. However, its configuration makes it unsuitable for use in bracing. Rather, the KANT-SAG® truss spacer can only be used to maintain the truss units at a proper spaced distance from each other, and, according to KANT-SAG®'s literature, can not be relied upon to provide bracing for the truss units.

Because of these deficiencies noted above, room exists for improvement by providing a bracing system which can be permanently installed on to truss units to allow the installation of decking with the bracing unit in place to reduce labor costs, but yet which is strong enough to provide an acceptable level of bracing in addition to the spacing function served by the truss brace.

It is therefore one object of the present invention to provide an improved truss brace system that provides both a bracing and a spacing function, but which can be permanently installed onto a truss unit system to thereby obviate the need for removal of the truss braces, and thereby reduce the labor costs associated with the removal of the bracing units from the truss system.

III. SUMMARY OF THE INVENTION

In accordance with the present invention, a brace is disclosed for providing lateral support to truss units of a truss system having at least a first, a second and a third truss unit, with each truss unit having at least one beam member. The brace comprises a generally continuous, elongated central leg having a first surface and a second surface. The second surface is positioned for engaging a first surface of the beam member of the first truss unit. The brace also includes an elongated first side leg disposed adjacent and generally perpendicular to the central leg. The first side leg includes at least one ear member disposed in a plane generally perpendicular to the central leg. The ear member is positionable generally flush to a second surface of the beam member of the first truss unit. The brace also includes a first opening adjacent to the ear member for receiving the beam member of the first truss unit.

In a preferred embodiment, the brace includes a longitudinally extending rib member which is formed as part of the central portion of the device, and extends outwardly from the second (or underside) surface of the central portion to extend below the plane of the upper surface of the central portion. The rib member also includes a series of openings aligned with the openings of the first leg member for receiving the beam of the truss unit. Further, the brace preferably includes a series of spaced openings designed for receiving a series of truss units. Each of the openings includes a first ear and a second ear which are placed in an opposed relation for respectively engaging opposing side surfaces of the beam members of the truss units. Fastening means, such as nails, can be provided for fastening the ear members to the beam units, and for fastening the central portion to the upper surface of the beam member.

Each of the first and second ears are formed as a part of the first side leg, with the first ear preferably comprising a first flap of the first side leg that is bent in a clockwise direction to be generally perpendicular to the first leg, and the second ear comprising a second flap of the first side leg bent in a counterclockwise direction to place the first and second ears in a generally opposed relation in parallel planes, separated by a distance generally slightly greater than the distance between the second and third surfaces of the beam member.

Further, the brace of the present invention can include a second side leg that includes a series of openings corresponding generally to the openings in the first side leg, and a series of ears generally similar to the ears of the first side leg. The openings in the second side leg can be laterally aligned with the openings in the first side leg to permit the brace to be used as a lateral brace, or can be diagonally offset from the openings in the first side leg to permit the brace to be used as a diagonal brace.

One feature of the present invention is that it produces a bracing system that is extendable across a plurality of truss units, This feature has the advantage of providing a single brace that can impart lateral stability to a plurality of upright truss units during the construction of a building. This feature permits the truss units to maintain their proper positioning during the construction process to help ensure proper structural integrity when the decking is attached to the truss units, and thereafter when construction is completed.

It is also a feature of the present invention that the brace is configured to be able to remain in place, attached to the truss units, even after the decking is attached to the truss units, and the roof is in place. This feature has a two-fold advantage. First, it reduces the labor costs when compared to some prior known bracing systems by obviating the need to remove the brace before attaching the decking to the truss unit system. Second, by remaining in place after the roofing or flooring system is in place, the bracing helps to add additional structural strength to the resulting roof or flooring system.

A further feature of the present invention is that it includes a longitudinal rib, and a plurality of outwardly extending, opposed ears. The longitudinal rib helps to provide additional structural integrity to the bracing system. The outwardly extending ears are attachable to the beam of the truss unit, and help to better secure the brace to the truss unit. In combination, the longitudinally extending rib and the ears help to provide additional structural integrity to the bracing system, which permits the bracing system to not only serve as a truss spacer, but also as a truss bracing system, thereby obviating the need, or reducing the need for additional brace units.

A further feature of the present invention is that the brace is a one piece design which can be formed through a stamping, rolling and bending process. This feature has the advantage of enabling the device to be produced at a cost low enough as to make it economically feasible to incorporate the brace into a building being constructed without the user being forced, by economic considerations, to remove it and reuse it. As such, the device has the potential to provide significant cost advantages to the builder using the brace, when compared to some known bracing systems that, although reusable, require a significant input of labor to attach and then remove from the building in which they are used. These and other features and advantages of the present invention will become apparent to those skilled in the art upon review of a detailed description of a preferred embodiment of the present invention, as presented below.

IV. BRIEF DESCRIPTION OF THE DRAWINGS

V. DETAILED DESCRIPTION

Figure 1:
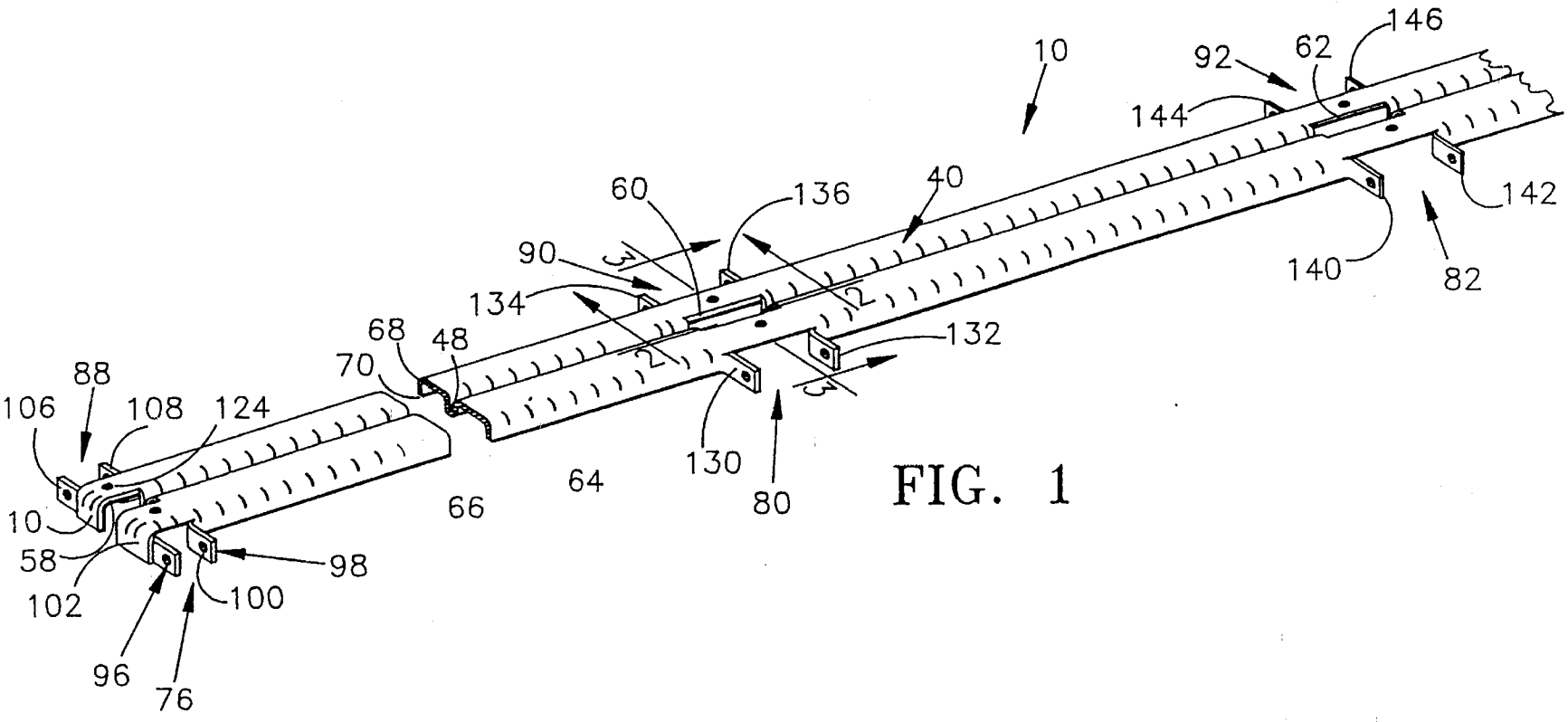
FIG. 1 is a perspective view of the brace of the present invention.
Figure 2:
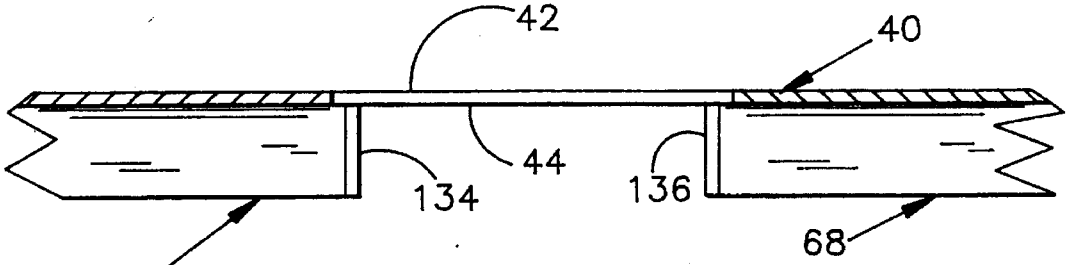
FIG. 2 is a sectional view taken along lines 2—2 of FIG. 1.
Figure 7:
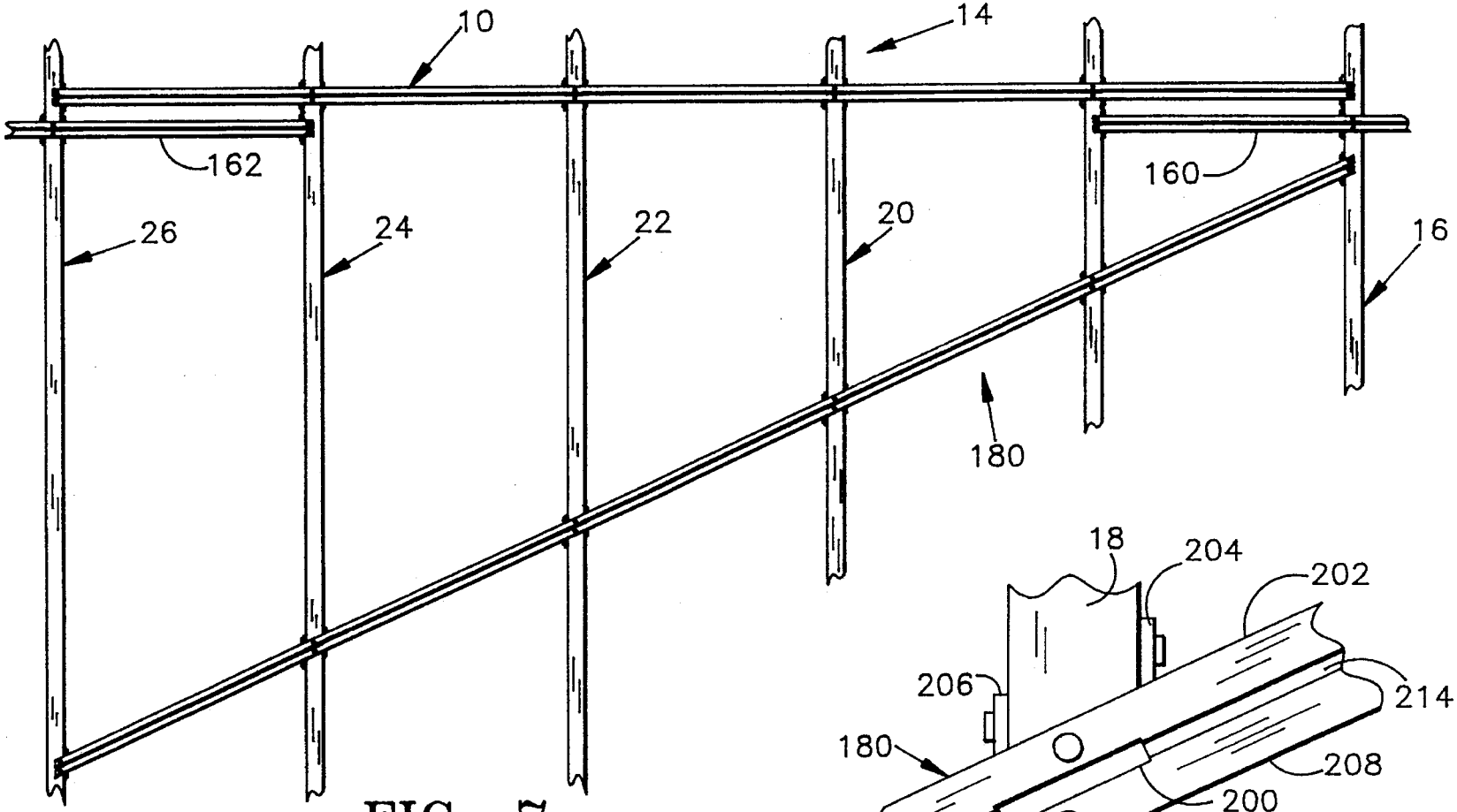
FIG. 7 is a top planar view of three lateral braces and one diagonal brace that are attached to a plurality of truss units of a truss system.
Figure 11:
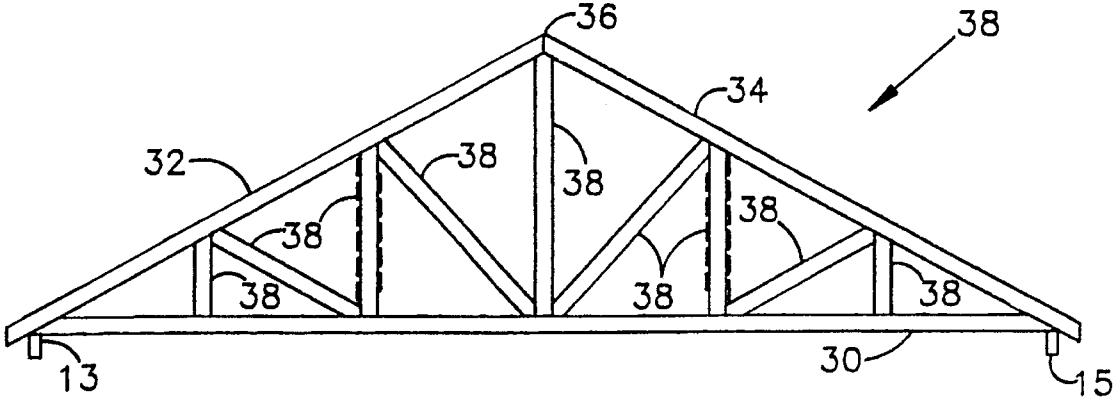
FIG. 11 PRIOR ART
FIG. 11 is a side view of a truss unit, of the type to which a brace of the present invention may be attached.

As best shown in FIGS. 1, 2 and 11, a brace 10 is shown for providing lateral support to truss units, such as truss unit 12 which form a part of a multi-truss unit truss system, such as the multi-unit truss system 14, a portion of which is shown in FIG. 7. As shown in FIG. 7, the truss system includes a plurality of truss units 16, 18, 20, 22, 24, 26. The truss units 16–26 of the truss system 14 can take a wide variety of shapes, sizes and configurations. Examples of such varied truss units are shown in the *TPI HANDBOOK* Although the brace 10 of the present invention would likely perform its intended function with almost any of the truss systems shown in the *TPI HANDBOOK*, for purposes of illustration in this description, all truss units will be presumed to have a shape and configuration generally similar to the truss unit 12 shown in FIG. 11.

Truss unit 12 is the type of truss unit that is typically used in residential construction to support a peaked roof. The truss unit 12 has a sufficient span to extend between a pair of support beams 13, 15 that are attached along the upper edge of a pair of opposing walls (not shown). Depending upon the configuration of the building, and the distance spanned between the support beams 13, 15 of the opposing walls, the truss units 16–26 may be supported at one or more points in the middle by another wall disposed somewhere between the opposing walls to which are attached support beams 13, 15.

As best shown in FIG. 11, the truss unit is made up of a plurality of elongated members. Typically, these elongated members comprise 2"×4", or larger wood pieces. The truss unit includes a base chord 30 which extends along the bottom of the truss unit 12 between the support beams 13–15. As base chord 30 probably plays the most significant role in the structural integrity of the truss unit 12, base unit 30 may be made of a substantially larger wood piece than any of the remaining members. The truss unit 12 also includes a pair of top chord beam members 32, 34. The top chord beam members 32, 34 of truss unit 12 each extend from a position slightly outwardly of their respective supporting beams 13, 15, and meet at a peak 36. As truss unit 12 is provided for forming a roof having a peak, truss units 34, 32 are disposed at an angle from horizontal, and intersect the base chord 30.

When a plurality of truss units are assembled together into a truss system, the upper surfaces of the respective top chords 32 of the truss units form a series of generally co-planar support surfaces which can be overlain by a planar piece of decking, such as a 4'×8' plywood sheet. Similarly, the upper surfaces of the array of top chords 34 of the truss units of the truss system are generally co-planar, for receiving a planar sheet of decking material. As the top chords 32, 34 form intersecting, angled lines which meet at the peak 36, the decking which is attached to the upper surfaces forms a pair of generally planar surfaces, wherein the planes are angled to each other, at an angle generally similar to the angle at which top chord 32 and top chord 34 meet.

The truss unit 12 also includes a series of web members 38, some of which extend generally vertically between the base chord 30 and one of the top chord members 32 or 34; and others of which extend diagonally between adjacent vertical web members.

Turning now to FIG. 7, during the construction of a building, a plurality of truss units 16–26 are placed in a parallel array so that each of the truss units 16–26 is generally upright. During the construction of a building, the placement of the truss units in an upright position requires attention to two important factors. First, the truss units 16–26 should be spaced so that the distance between each truss unit is both similar, and complies with applicable building codes. In most states, the preferred distance for spacing between adjacent truss units of a truss system used in connection with a roof of a residential structure is approximately two feet. However, other states and other building types have varying requirements which may mandate either a greater or lesser spacing between adjacent truss units.

The second factor with which one must deal is maintaining the truss units in their upright position. When a truss unit 12 is attached in an upright position to a pair of opposing walls 13, 15, the truss unit has very little lateral stability. Often, the exertion of any significant lateral force against the truss unit 12 will cause one or more truss units to topple over. Such lateral forces can be exerted by nature, such as when a strong wind blows, or can be exerted by the construction crew by either bumping into a truss unit 12, or by placing material on the top chords 32, 34 of the truss unit 12. When a plurality of truss units are arrayed in a parallel array, such as shown in FIG. 7, the toppling of one truss unit (e.g., 16) in a direction toward another truss unit (e.g., 18) can cause a "domino effect," wherein all of the truss units 16–26 will topple over. Such a toppling over of a plurality of truss units can add to the expense of construction through the requirement of additional labor to set the truss units back in an upright position. Further, the toppling over of the truss units could create a dangerous situation to workers, especially those workers who may be on top of the truss system installing decking.

The brace 10 of the present invention is designed to provide lateral bracing for the truss units 16–26 of a truss system, to help maintain the truss units 16–26 in their upright position during the construction of the building, and more particularly during the placement of the decking on the top chords 32, 34 of the truss units.

The brace of the present invention that performs this function is shown in FIGS. 1–10.

Figure 3:
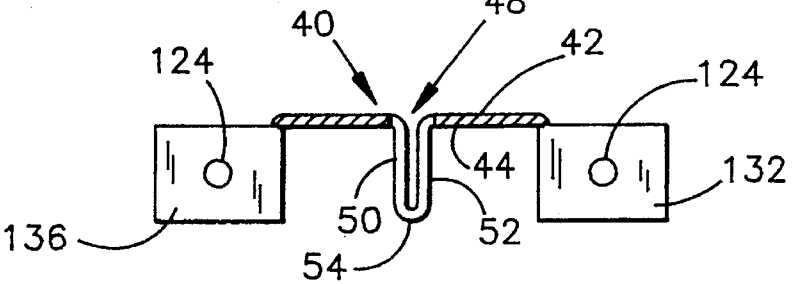
FIG. 3 is a sectional view taken along lines 3—3 of FIG. 1.

The brace 10 is preferably formed from an elongated, generally planar sheet of 22 to 26 gauge steel, having a length of about 10'4", and a width of about 4.5". This generally planar sheet of steel is then stamped, roll formed, and bent, where appropriate, to form the brace shown in FIG. 1. When so formed, the brace member 10 includes a generally continuous, elongated central leg 40 which extends generally along the entire length of the brace 10. The central leg 40 has a first, or upper side surface 42 (FIG. 3) and a second, underside surface 44. A central rib 48 extends longitudinally down substantially the entire length of the central leg 40. As will be discussed in more detail below, the central rib 48 is discontinuous, being interrupted by cut-out portions that form openings for receiving beam members of the truss units 16–26. The longitudinally extending db 48 lies in a plane generally perpendicular to and out of the major plane of the central leg 40. As shown in FIG. 3, the rib 48 extends outwardly from the second side surface 44 of the central leg 40, and includes a first downwardly extending portion 50, and a second downwardly extending portion 52, which meet at a crease 54. As with all other pieces of the brace 10, the rib 48 is unitarily formed out of the same sheet-like piece of steel as are all other elements and portions of the brace unit 10.

As stated above, the rib 48 includes a series of stamped-out portions which define a series of openings. In FIG. 1, there is shown a first opening 58, a second opening 60, and a third opening 62. The first, second and third openings 58, 60, 62 are provided for receiving the first or upper side surfaces 116 of the top chord beam members, 32 or 34. Turning now to FIG. 7, the first opening 58 is provided for receiving the top chord beam member of the first truss unit 16; second opening 60 is provided for receiving the top chord beam member of the second truss unit 18; and third opening 62 is provided for receiving the top chord beam member of the third truss unit 20.

Returning now to FIG. 1, the brace 10 includes a generally downwardly extending first side leg 64 which is formed at one side of the central leg 40, and is disposed in a plane generally perpendicular to the plane of the central leg 40. The brace 10 also includes a generally downwardly extending second side leg 68 which is formed at the other side of the central leg 40, and is disposed in a plane generally perpendicular to the central leg 40. Each of the first side legs 64 and second side legs 68 extend generally along the entire length of the brace 10, and are also disposed in generally parallel planes. Each of the first and second side legs 64, 68 terminate at a lower edge 66, 70, respectively.

The first side leg 64 defines a series of spaced openings including a first opening 76, a second opening 80, and a third opening 82. The distance between the respective openings, 76 and 80, and 80 and 82 is the same as the preferred distance between adjacent truss units, 16 and 18; and 18 and 20, respectively. As shown in FIG. 7, the braces 10 are preferably long enough to span the five spaces between a series of six truss units 16–26 so that although only three openings 76, 80, 82 are shown in the first leg of FIG. 1, the brace 10 preferably includes six openings, one for each of the six truss units 16–26. Returning back to FIG. 1, the second leg 68 is similar, and includes a first opening 88 for receiving the top beam of the first truss unit 16, a second opening 90 for receiving the top beam of the second truss unit 18, and a third opening 92 for receiving the top beam of the third truss unit 20.

The respective first openings 76–88 of the first and second side legs 64, 68 are terminal openings. Each includes a generally outwardly extending first ear 96, and a second ear 98. First and seconds ears 96, 98 are placed in an opposed relation, and are disposed in parallel planes. To form the first and second ears 96, 98, a T-shaped cut is made in the first side leg 64. The first ear 96 is then bent 90 degrees in a generally clockwise direction so that it extends in a plane generally perpendicular to each of the first side leg 64 and central leg 40. The second ear 98 is bent in a generally counter-clockwise direction so that it too is disposed in a plane generally perpendicular to each of the first side leg 64 and central leg 40. When so bent, the first and second ears 96, 98 are disposed in generally parallel planes. As the ears 96, 98 are part of the first, or terminal opening 76, the end of the central leg 40 is bent downwardly to form a downwardly extending terminal flange 102 which is generally co-planar with the first ear 96. The first and second ears 106, 108 of the first opening 88 of the second side member 68 are formed generally similarly, as is the downwardly extending terminal flange 110, which is formed from the central leg 40. The opening 58 formed by the stamping out of a portion of the longitudinal rib 48 of the central portion 40 causes the terminal flanges to comprise a pair of terminal flanges 102, 110, rather than a single, continuous terminal flange.

Figure 9:
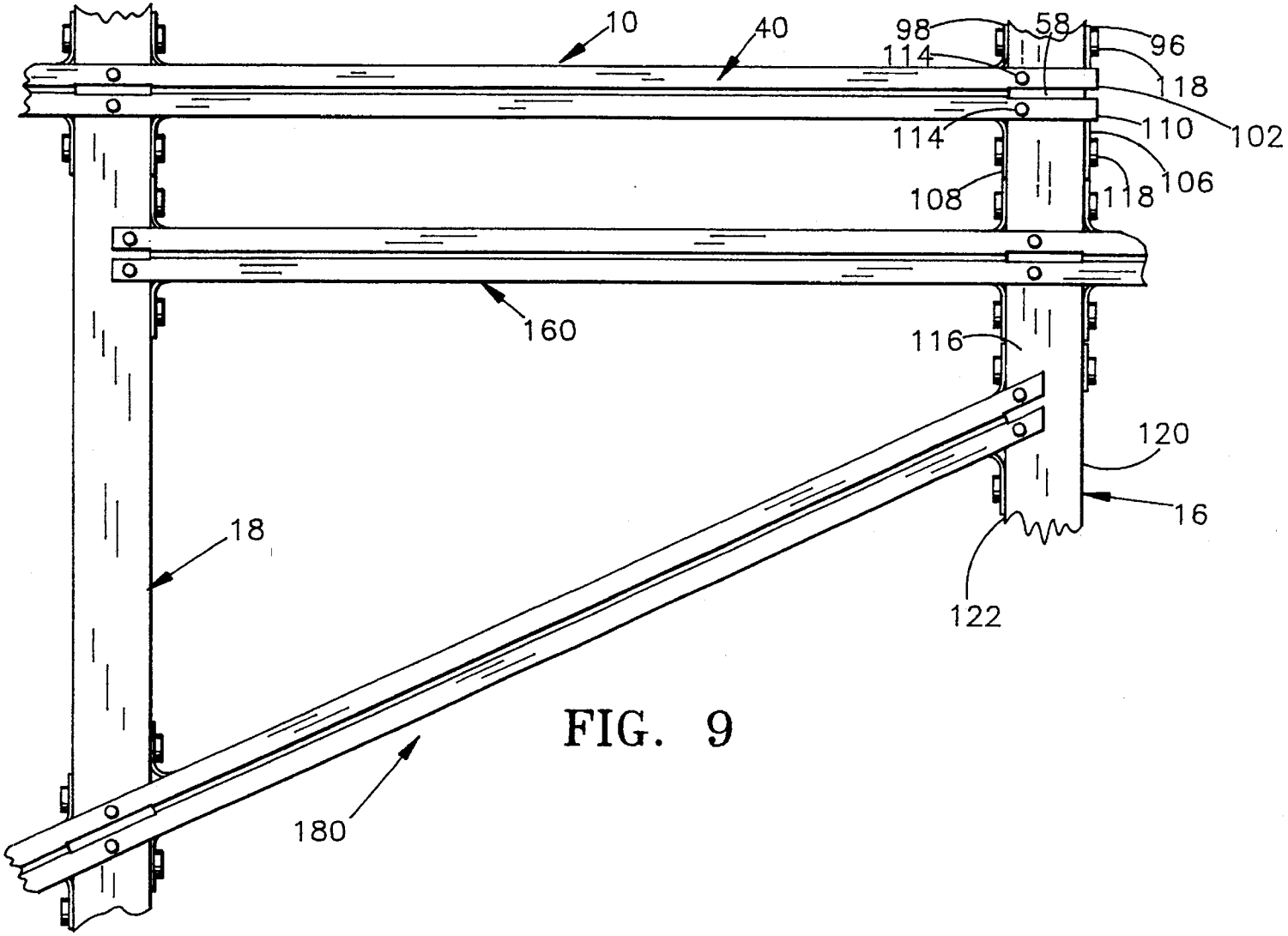
FIG. 9 is an enlarged, top planar, fragmentary view of two lateral braces and one diagonal brace, showing the same attached to a pair of beam members of a pair of truss units.

When the terminal flanges 102, 110 are bent downwardly, and the ears 96, 98, 106, 108 are bent outwardly, an opening is formed for receiving a beam member of a truss unit. In particular, the opening is provided for receiving the top chord of the first truss unit 16. Openings 76, 58, and 88 are all aligned, so that the generally linear top chord member of the first truss unit 16 can be received therethrough. As brace 10 is shown in FIG. 7 as being a generally lateral brace that is disposed essentially perpendicularly to each of the top chord members 32, 34 of the respective truss units 16–26, each of the respective terminal flanges 102, 110 first ears 96, 106, second ears 98, 108, and openings 76, 58 and 88 are aligned along a series of lines generally perpendicular to the longitudinal extent of the beam 10, and are not laterally offset from each other. As best shown in FIG. 9, when the brace 10 is attached to the first truss unit 16, the second side surface 44 (FIG. 3) is provided for receiving, and is disposed generally flush to the first side surface 116 of the beam member of truss unit 16. The first ears 96, 106 are disposed generally flush to a second side surface 120 of the beam member of the truss unit 16, and the second ears are disposed generally parallel and flush with a third side surface 122 of the beam member of the truss unit 16.

Figure 10:
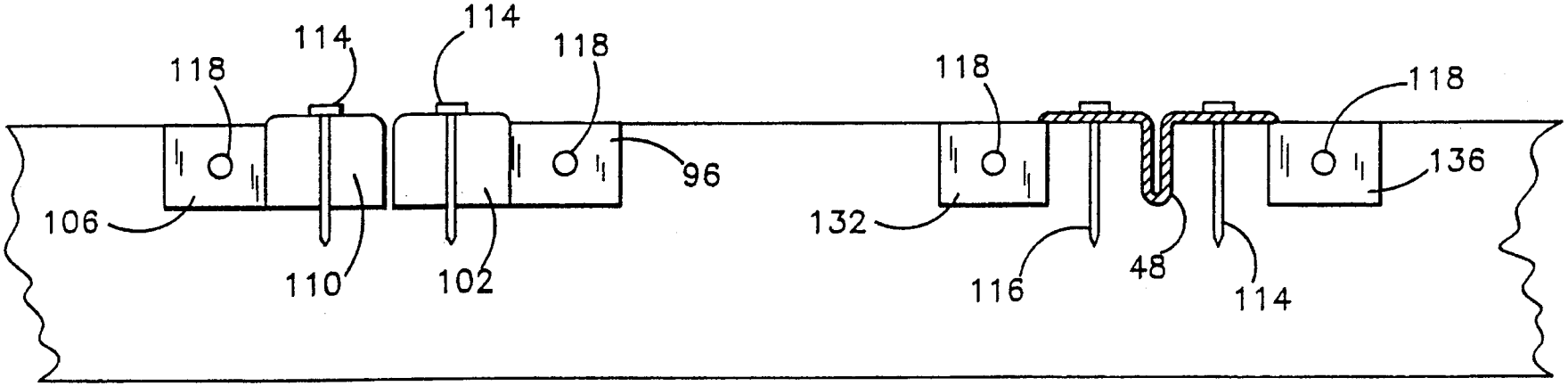
FIG. 10 is a partially sectional end view of a pair of brace members coupled to a beam member of a truss unit.

As best shown in FIGS. 1, 3 and 10, the central leg 40 includes a pair of apertures 124 adjacent the opening, and each of the ears 96, 98, 106, 108 include a single aperture. These apertures are provided for receiving fastening means, such as nails 114, 118 (FIG. 9), for fastening the respective central leg and ears 96, 106, 98, 108 to the beam member of the truss unit 16. When the nails 114, 118 are extended through the apertures, the brace 10 becomes attached securely to the beam member of the truss unit 16. As the brace 10 provides for six points at which nails can attach the brace member 10 to each beam unit 16, the attachment between the brace 10 and the beam becomes secure, and not likely to become unattached. Additionally, as the ears 96, 98, 106, 108 and central leg 40 receive and engage the beam member of the truss unit 16 on three of its four surfaces, the beam member 16 is prevented from moving laterally out of engagement with the brace 10. As such, the engagement of the brace 10 to the beam member of the truss unit 16 maintains the beam member of the truss unit 16 and hence the entire truss unit in its upright, vertical position, and makes it difficult for the truss unit 16 to topple over.

Returning now to FIG. 1, the second opening 80 of the first side leg 64 is also defined by a pair of opposed first and second ears 130, 132. Similarly, opening 90 of the second side leg 68 includes the first 134 and second 136 opposed ears. Ears 130–136 are generally similar, and are formed in a generally similar manner to ears 96, 98, 106, 108 respectively. However, as second openings 80, 90 are not terminal openings, there exists no terminal flanges adjacent to the first ears 130, 134. As brace 10 is a lateral brace (as opposed to a diagonal brace) the openings 60, 80, 90 and the respective ears 130, 132, 134, 136 are not laterally offset, to permit the beam of the second truss unit 24 to be received generally perpendicularly to the longitudinal extent of the brace 10.

The third opening 82 of the first side leg 64 also includes a first and second opposed ears 140, 142, and third opening 92 of the second side leg 68 includes first and second opposed ears 144, 146, which are generally similar to those of the second openings.

Figure 4:
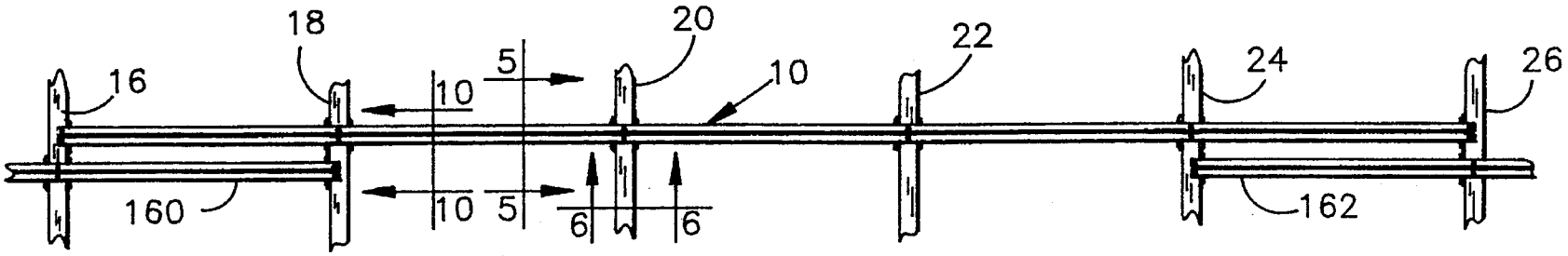
FIG. 4 is a top planar view of three lateral braces of the present invention attached to a plurality of truss units of a truss system.
Figure 5:
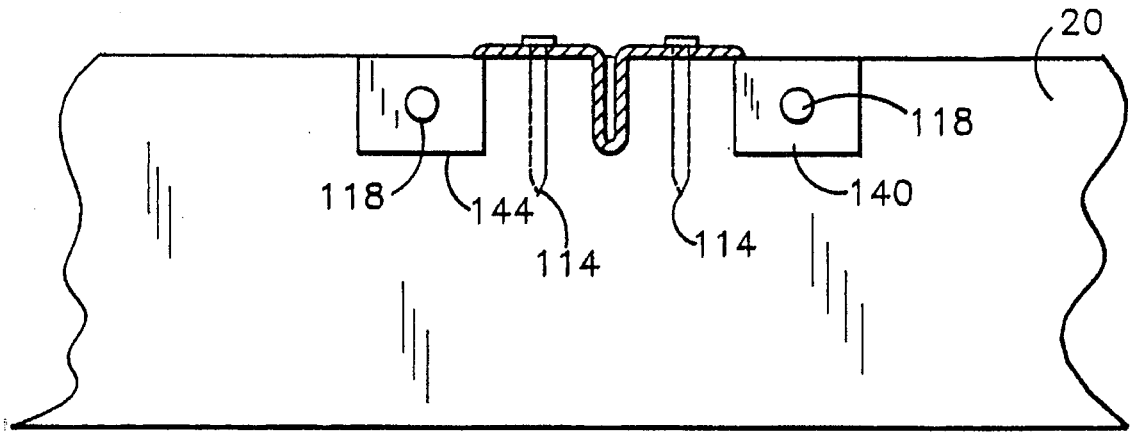
FIG. 5 is a sectional view taken along lines 5—5 of FIG. 4.

As best shown in FIG. 4, the brace 10 is generally long enough to span the distance between six truss units 16–26. Thus, if the braces were laid end to end, a series of five braces could theoretically span 26 truss units, assuming that the second end of each brace member was attached to the same truss unit as the first end of the next brace 10. However, this practice is not advised by the applicant, as the purpose of the brace unit is to provide a sufficient amount of bracing of the truss units, to prevent toppling. To this end, the longitudinally extending rib 48 provides a large degree of structural rigidity to the brace member, to prevent the brace member from flexing upwardly or downwardly out of its plane. Nonetheless, it is believed that a better practice is to provide some overlap among the braces, so that the span between the end truss units, e.g., 16, 26, and their adjacent truss units, e.g., 18, 24, respectively, is spanned by a pair of brace members. As such, the hypothetical 26 truss unit truss system span discussed above should actually require the use of six brace units, each of which is capable of spanning five spaces between six truss units. Through this overlapping arrangement, additional structural rigidity is imparted to the assembled truss unit, which helps to provide an additional margin of safety and structural integrity to the truss units.

Figure 6:
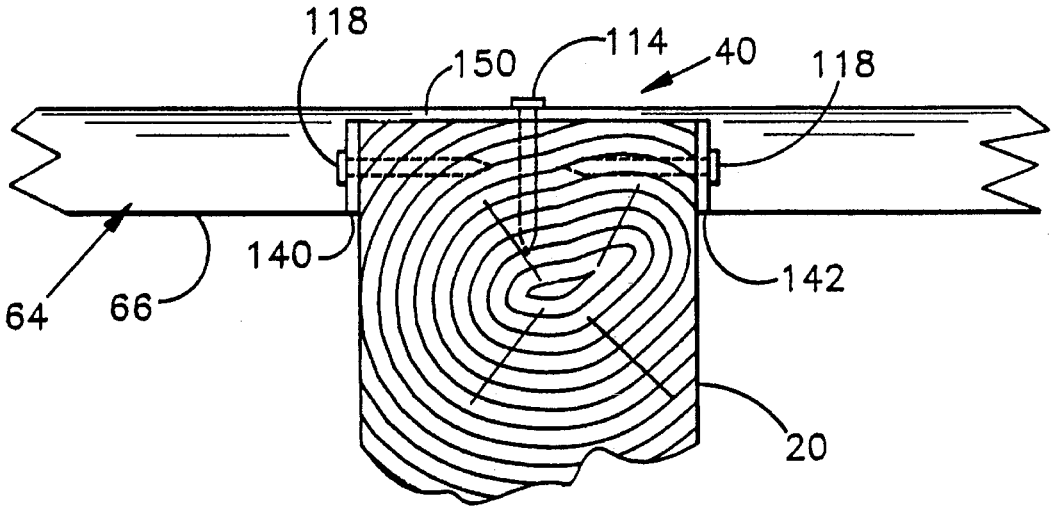
FIG. 6 is a sectional view taken along lines 6—6 of FIG. 4.

As best shown in FIGS. 2 and 6, that part of the central leg 40 which overlays the first surface of a beam member 20 forms a generally sheet-like, planar bridge 150. This generally planar bridge is sufficiently thin so that decking material can be placed over the bridge 150, and still attached by nails or tacks directly to the beam members of the respective truss units 16–26. Because of this thinness, the decking member can be laid directly over the brace unit 10, thus obviating any need for removing the brace 10 prior to installation of the decking material. By leaving the brace 10 in place on the truss units 16–26 after the decking is installed, the brace 10 is allowed to impart additional structural rigidity to the roof of the building. Additionally, the contractor can save substantial labor costs by obviating the need to pay for the labor to remove the bracing from the truss unit, as with some prior art devices.

Figure 8:
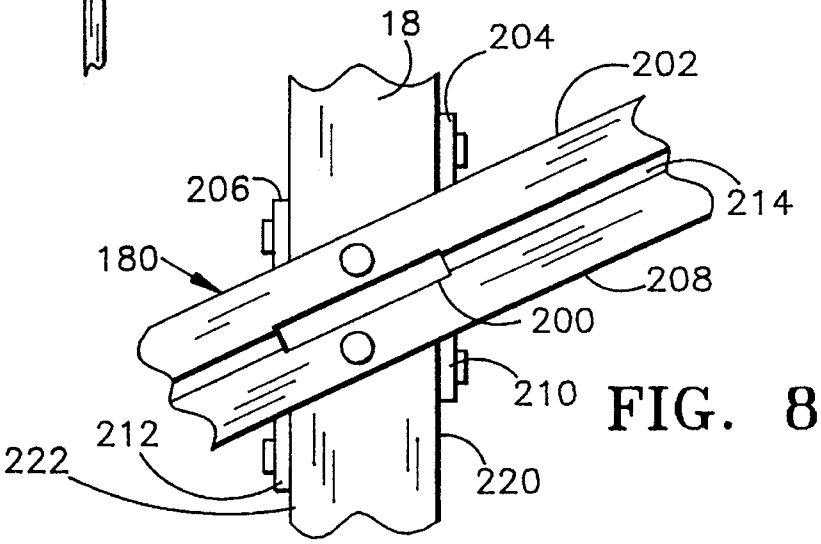
FIG. 8 is a top, fragmentary view of a diagonal brace, showing the brace joined to a beam member of a truss unit.

Your attention is now directed to FIGS. 7–9 which show various aspects of the brace member of the present invention configured slightly differently to serve as a diagonal brace, such as diagonal brace 180. In FIGS. 7 and 9, it should be noted that, for ease of description, the first end of the lateral brace 10 containing first opening 58 has been rotated 180° so as to appear on the right side of the drawing, rather than the left side of the drawing, as shown in FIGS. 1–6 and 10. Additionally, first truss unit 16 is shown being positioned to the right of second truss unit 18, whereas on FIG. 4, first truss unit 16 is to the left of second truss unit 18. This reorientation does not have any necessary effect on the structure and function of the lateral brace units 10, 160, 162, as their design makes it unimportant whether the first end is placed to the right relatively, or to the left.

Turning now to FIGS. 7–9, it will be shown that a diagonal brace 180 is used to impart additional structural rigidity. As discussed in the *TIP HANDBOOK*, a diagonal brace, such as diagonal brace 180, should be used along with lateral braces, such as lateral brace 10 to provide an additional margin of safety. Diagonal brace 180 is generally similar to lateral brace 10, except in two particular areas. First, diagonal brace 180 will need to be longer than lateral brace 10 to span the same number of braces 16–26. If, for example, diagonal brace 180 is placed at a 45 degree angle to lateral brace 10, diagonal brace 180 will need to be 1.414 times as long as lateral brace 10 to span the same number of braces. Similarly, if diagonal brace 180 is placed at a 30 degree angle to lateral brace 10, it will need to be approximately 1.155 times as long as lateral brace 10, in order to span the same number of braces.

The second difference relates to the manner in which the openings are constructed. As best shown in FIG. 8, the second opening 200 of the diagonal brace 180 includes a first side leg 202 having a first outwardly bent ear 204, and a second outwardly bent ear 206, which define an opening in the first side leg 202. Similarly, the second side leg 208 includes a first outwardly bent ear 210, and a second outwardly bent ear 212 which define an opening in the second side leg 208. However, as the diagonal brace 180 receives the beam of the truss unit 118 at an angle, the respective openings in the first side leg 202, longitudinal rib 214 and second side leg 208 are laterally offset from each other to place the truss unit 18 in a proper orientation relative to the diagonal brace 180. Additionally, in order to place the respective ears 204, 206, 210, 212 in a position flush to the respective first and second side surfaces 220, 222 of the beam, the ears are placed at an oblique angle to the respective side legs 202, 208, and are not perpendicular as is the case with the lateral brace 10.

Additionally, the terminal downwardly extending flanges of the diagonal member are also bent at a slightly different angle to properly receive the end braces.

From the foregoing description, it will be appreciated that the lateral and diagonal braces of the present invention can provide a secure and efficient means for both ensuring proper spacing for truss units in a truss system, and for bracing these truss units during the construction of a building. The particular number of brace units used, and their configuration (number of diagonal and lateral units used), etc. can be determined on a building by building basis in accordance with generally accepted construction and engineering principles.

Having described the invention in detail, and by reference to the preferred embodiments thereof, it will be apparent that modifications and variations are possible without departing from the scope of the invention as defined in the appended claims.

What is claimed is:

1. A brace for providing lateral support to truss units of a truss system having at least a first, a second and a third truss unit, with each truss unit having at least one beam member, the brace comprising (1) a generally continuous, elongated central leg having a first surface and a second surface, the second surface being positioned for engaging a first surface of the beam member of the first truss unit, and (2) an elongated, first side leg disposed adjacent and generally perpendicular to the central leg, the first side leg including (a) a first ear member disposed in a plane generally perpendicular to the central leg, the first ear member being adapted to be positionable generally flush to a second surface of the beam member of the first truss unit, and (b) a first opening adjacent to the first ear member for receiving the beam member of the first truss unit and (c) a second ear member placed adjacent to the first opening in an opposed relation to the first ear member, the second ear member being adapted to be positionable generally flush to a third surface of the beam member of the first truss unit, each of the first and second ear members being formed as a part of the first side leg, the first ear member comprising a first flap of the first side leg bent in a clockwise direction to be generally perpendicular to the first side leg, the second ear member comprising a second flap of the first side leg bent in a counterclockwise direction to place the first and second ear members in a generally opposed relation in parallel planes separated by the first opening having a distance adapted to be generally slightly greater than the distance between the second and third surfaces of the beam member.

2. The brace of claim 1 wherein the first side leg includes a second opening spaced from the first opening for receiving a beam member of a second truss unit, and a first ear member disposed adjacent to the second opening and being adapted to be positionable generally flush to a second surface of the beam member of the second truss unit, the first ear member adjacent the second opening being disposed in a plane generally perpendicular to each of the central leg and the first side leg.

3. The brace of claim 2 wherein the first side leg includes a third opening spaced from the first opening for receiving a beam member of a third truss unit, and a first ear member disposed adjacent to the third opening and being adapted to be positionable generally flush to a second surface of the beam member of the third truss unit, the first ear member adjacent the third opening being disposed in a plane generally perpendicular to each of the central leg and the first side leg.

4. The brace of claim 1 wherein each of the central leg and first ear member includes an aperture through which a fastening means can pass for fastening the brace to the first truss unit.

5. The brace of claim 1 wherein at least one of the central leg and first ear includes a fastening means for fastening the brace to the first truss unit.

6. The brace of claim 1 wherein the first side leg includes a second opening spaced from the first opening for receiving a beam member of the second truss unit, and first and second opposed ear members disposed adjacent the second opening and being adapted to be positionable generally flush to a second surface of the beam member of the second truss unit, the first and second ear members being disposed in generally parallel planes.

7. The brace of claim 1 further comprising a second side leg disposed adjacent and generally perpendicular to the central leg, and in a plane generally parallel to and spaced from the first side leg.

8. The brace of claim 7 wherein the second side leg includes opposed first and second ear members, the first and second ear members defining a first opening of the second side leg, aligned with the first opening of the first side leg for receiving said beam member of the first truss unit.

9. The brace of claim 8 wherein the first and second side legs each include a second opening spaced from the first opening, the second openings of the first and second side legs each including first and second opposed ears defining the respective second openings, the second openings of the first and second side legs being aligned for receiving a beam member of a second truss unit.

10. The brace of claim 1 wherein the central leg, first side leg and ear member are each formed of sheetlike material for permitting decking material to be placed over the first surface of the central leg and attached to the first surface of the beam of the first truss unit.

11. A brace for providing lateral support to truss units of a truss system having at least a first, a second and a third truss unit, with each truss unit having at least one beam member, the brace comprising (1) a generally continuous, elongated central leg having a first surface and a second surface, the second surface being positioned for engaging a first surface of the beam member of the first truss unit, the central leg including a longitudinally extending rib member unitarily formed with the central leg and extending generally outwardly from the second side surface of the central leg, the rib member including a first portion and a second portion, each of which are disposed in a plane generally parallel to the first side leg and perpendicular to the central leg, and (2) an elongated, first side leg disposed adjacent and generally perpendicular to the central leg, the first side leg including (a) at least one ear member disposed in a plane generally perpendicular to the central leg, the ear member being adapted to be positionable generally flush to a second surface of the beam member of the first truss unit, and (b) a first opening adjacent to the ear member for receiving the beam member of the first truss unit, wherein the rib member includes at least one opening positioned adjacent the first opening of the first side leg for receiving the beam member of the first truss unit.

12. The brace of claim 11 wherein the first side leg includes a second opening spaced from the first opening for receiving a beam member of a second truss unit, and a first ear member disposed adjacent to the second opening and being positionable generally flush to a second surface of the beam member of the second truss unit, the first ear member being disposed in a plane generally perpendicular to each of the central leg and the first side leg.

13. The brace of claim 12 wherein the first side leg includes a third opening spaced from the first opening for receiving a beam member of a third truss unit, and a first ear member disposed adjacent the third opening and being positionable generally flush to a second surface of the beam member of the third truss unit, the first ear member being disposed in a plane generally perpendicular to each of the central leg and the first side leg.

14. A brace for providing lateral support to truss units of a truss system having at least a first, a second and a third truss unit, with each truss unit having at least one beam member, the brace comprising (1) a generally continuous, elongated central leg having a first surface and a second surface, the second surface being positioned for engaging a first surface of the beam member of the first truss unit, and (2) an elongated, first side leg disposed adjacent and generally perpendicular to the central leg, the first side leg including (a) at least one ear member disposed in a plane generally perpendicular to the central leg and the first side leg, the ear member being adapted to be positionable generally flush to a second surface of the beam member of the first truss unit, and (b) a first opening adjacent to the ear member for receiving the beam member of the first truss unit (3) second side leg disposed adjacent and generally perpendicular to the central leg, and in a plane generally parallel to and spaced from the first side leg, the second side leg including (a) at least one ear member disposed in a plane generally perpendicular to the central leg and the second side leg, the ear member being adapted to be positionable generally flush to a second surface of the beam member of the first truss unit, and (b) a first opening adjacent the ear member for receiving the beam member of the first truss unit.

15. The brace of claim 14 wherein the first openings of the first and second side legs are longitudinally offset so that when the beam member of the first truss unit is received by the first openings of the first and second side legs, the axis of the brace member is disposed at angle to the beam of other than between 80 degrees and 100 degrees.

16. A brace for providing lateral support to a series of upright truss units of a truss system having at least first, second and third truss units, with each truss unit having at least one beam member having a first surface, the first beam surfaces being generally co-planar, the brace comprising (1) a generally continuous elongated central leg having a first surface, a second surface positioned for engaging a first surface of the beam members of the first, second and third truss units, and a longitudinally extending rib member unitarily formed with the central leg and extending generally outwardly from the second side surface of the central leg, the rib member including a first opening for receiving the first truss unit, a second opening for receiving the second truss unit, and a third opening for receiving the third truss unit, (2) an elongated first side leg disposed adjacent and generally perpendicular to the central leg, the first side leg including (a) a first opening for receiving the first truss unit, a second opening for receiving the second truss unit, and a third opening for receiving the third truss unit, each of the openings of the central leg being generally aligned with the respective openings of the first side leg (b) a first and a second ear disposed adjacent to each of the first, second and third openings of the first side leg, each of the first ear members being adapted to be positionable adjacent to the second side surfaces of the beam members of the respective first, second and third truss units, and each of the second ear members being adapted to be positionable adjacent to the third side surface of the beam members of the respective first, second and third truss units, wherein the central leg is comprised of a sheet-like material for permitting decking material to be placed over the first surface of the central leg and attached to the first surface of the beams of the first, second and third truss units.

17. The brace of claim 16 wherein the at least one beam member also includes a second surface and a third surface, further comprising an elongated second side leg disposed adjacent and generally perpendicular to the central leg, and in a generally parallel plane with the first side leg, the second side leg including (1) a first opening for receiving the first truss unit, a second opening for receiving the second truss unit, and a third opening for receiving the third truss units, the first, second and third openings of the second side leg being generally aligned with the respective first, second and third openings of the longitudinal rib and the first side leg for permitting the respective first truss member to pass through each of the respective first openings, the second truss member to pass through the respective second openings, and the third truss member to pass through the respective third openings, (2) a first and second ear disposed adjacent to each of the first, second and third openings of the second side leg, each of the first ear members being positionable adjacent to the second side surfaces of the beam members of the respective first, second and third truss units, and each of the second ear members being positionable adjacent to the third side surfaces of the beam members of the respective first, second and third truss units.

* * * * *

UNITED STATES PATENT AND TRADEMARK OFFICE

CERTIFICATE OF CORRECTION

PATENT NO. : 5,606,837

DATED : March 4, 1997

INVENTOR(S) : Mark A. Holtzlander

It is certified that error appears in the above-indentified patent and that said Letters Patent is hereby corrected as shown below:

On Column 1, line 43, after "Examples", please delete ",".

On Column 1, line 50, after "bracing", please delete "them" and insert --the--.

On Column 2, line 41, after "which is shown in", please delete "their" and insert --its--.

On Column 2, line 62, after "the upper surface of a", please delete "bem" and insert --beam--.

On Column 3, line 20, after "literature,", please delete "can not" and insert --cannot--.

On Column 4, line 26, after "units", please delete "," and insert --.--.

On Column 7, line 23, after "extending", please delete "db" and insert --rib--.

Signed and Sealed this

Seventh Day of October, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5, 606,837
DATED : March 4, 1997
INVENTOR(S) : Mark A. Holtzlander

It is certified that error appears in the above-identified patent and that said Letters Patent is hereby corrected as shown below:

On the title page, item [76] Inventor, "Mark A. Holizlander" should read --Mark A. Holtzlander--.

Signed and Sealed this

Tenth Day of February, 1998

*Attest:*

*Attesting Officer*

BRUCE LEHMAN

*Commissioner of Patents and Trademarks*